US005184152A

United States Patent [19]

French

[11] Patent Number: 5,184,152

[45] Date of Patent: Feb. 2, 1993

[54] PRINTING APPARATUS AND METHOD FOR PRINTING ON AN ELONGATED MEMBER SUCH AS A TUBE

[75] Inventor: John B. French, San Clemente, Calif.

[73] Assignee: Sumimoto Electric Interconnect Products, Inc., Sunnyvale, Calif.

[21] Appl. No.: 624,883

[22] Filed: Dec. 4, 1990

[51] Int. Cl.[5] ..... B41J 3/407

[52] U.S. Cl. ..... 346/76 PH; 101/DIG. 46

[58] Field of Search ..... 346/76 PH, 1.1; 400/705; 101/11, DIG. 46

[56] References Cited

U.S. PATENT DOCUMENTS

| | | | |
|---|---|---|---|
| 4,029,006 | 6/1977 | Mercer | 346/75 |
| 4,082,039 | 4/1978 | Schutt et al. | 101/DIG. 46 |
| 4,503,437 | 3/1985 | Katzschner | 346/75 |
| 4,738,553 | 4/1988 | Uemura et al. | 346/76 PH |
| 4,839,737 | 6/1989 | Saito | 346/76 PH |
| 4,906,170 | 6/1990 | Nelson et al. | 346/24 |

FOREIGN PATENT DOCUMENTS

| | | | |
|---|---|---|---|
| 2705282 | 8/1978 | Fed. Rep. of Germany | 400/705 |
| 1803925 | 1/1979 | Fed. Rep. of Germany | 101/DIG. 46 |
| 0128994 | 1/1988 | Japan . | |
| 0082764 | 4/1988 | Japan | 400/613 |
| 0207672 | 8/1988 | Japan . | |

OTHER PUBLICATIONS

"Thermal Printheads KST Series", Kyocera International, Inc., San Diego (1986).

*Primary Examiner*—Benjamin R. Fuller
*Assistant Examiner*—N. Le
*Attorney, Agent, or Firm*—Gordon L. Peterson

[57] ABSTRACT

A printing apparatus including a supporting structure and structure for mounting a reel for rotation on the supporting structure. Tubing is wound on the reel and encoded information relating to a characteristic of the tubing is provided on the reel. The tubing can be pulled from the reel and moved through the printing apparatus. A controllable printer is mounted on the supporting structure for printing on the tubing. A sensor senses the encoded information and a microprocessor controls the printer in accordance with the encoded information sensed by the sensor so that the printer is controlled in accordance with the characteristic of the tubing.

22 Claims, 5 Drawing Sheets

PRINTING APPARATUS AND METHOD FOR PRINTING ON AN ELONGATED MEMBER SUCH AS A TUBE

BACKGROUND OF THE INVENTION

It is often necessary or desirable to print alphanumeric information, as well as designs and logos on a variety of elongated members, such as tubing. The information to be printed typically depends upon one or more characteristics of the elongated member or a characteristic of an element with which the elongated member is to be used. For example, in the case of tubing, the information to be printed may depend on the diameter, wall thickness, material, color or other characteristic of the tubing. In addition, it may be desirable to utilize the printing apparatus only in connection with authorized tubing for the printing apparatus.

One prior art printing apparatus for tubing employs a hot stamp which forces a foil against a tube to form, in effect, a brand on the tubing. This technique requires a change of type or die for different sizes of lettering that may be required for different diameters of tubing. Also, the type or dies must be changed for languages employing different characters, as well as for designs and logos.

Dot impact printers have also been used for printing on tubing. With this technique, dots are extended against a ribbon to transfer pigment to the tubing, and the printhead is required to traverse across the tubing during the printing operation. In addition it is sometimes difficult to print characters, such as oriental characters, on tubing of small diameter.

For flattened tubing, a daisy wheel printer can be used. However, this requires wheel changes for size and language changes and is generally subject to the disadvantages noted above for the hot-stamp technique.

In the field of labelling it is known to weigh a product and have a computer command a printer to print the weight of the product on the label for that product.

Thermal printheads are available and have the advantage of being controllable with a microprocessor. Thermal printheads are usable in a variety of applications, including facsimile and ticket machines, various printers, including label and bar printers, data recorders, various instruments, word processors and typewriters. However, insofar as I am aware, thermal printers have not been used for printing on tubing.

Typically, thermal printers are used to print on paper. It is known for an operator to key into a microprocessor information that the thermal printer is to print. This creates the possibility of operator error and requires the attendance of the operator to perform this function.

SUMMARY OF THE INVENTION

This invention provides a printing apparatus for printing on an elongated member. With this invention, certain aspects of control of the printing apparatus are removed from the operator and carried out automatically thereby reducing the likelihood of operator error and increasing efficiency.

The elongated member may be any elongated element on which it is desired to print. For example, the elongated member may be tubing, such as shrink tubing, a string of tickets or tags, adhesive labels on a backing strip and various other print receptors. The elongated member may be wound on a reel or provided in one or more strips.

Encoded information relating to at least one characteristic of the elongated member is associated with the elongated member. The association between the encoded information and the elongated member may take different forms. For example, the encoded information, which may be in the form of a bar code, may be on a reel on which the elongated member is wound or on the elongated member itself. Alternatively, the encoded information may be on a container for one or more strips when the elongated member is provided in strip form.

According to one aspect of this invention, the elongated member is wound on a reel, and the reel or elongated member bear encoded information relating to at least one characteristic of the elongated member. A sensor reads or senses the encoded information and provides a signal to a microprocessor which controls a printer in accordance with the encoded information. The characteristic of the tubing set forth in the encoded information can be any one or more of a variety of facts or conditions regarding the elongated member or an element with which the elongated member is to be used. For example, the characteristic may be whether the elongated member is authorized for use with this printer, and in this event, the printer is operated to print on the elongated member only if the elongated member is authorized. This feature is useful, for example, to reduce the likelihood of damaging the elongated member or the printing apparatus, for warranty considerations, etc.

The characteristic may also identify other facts about the elongated member, such as its material, diameter, color, model number, etc. which can then be automatically printed on the elongated member without danger of operator error. For example, in the case of shrink tubing, the characteristic may be an identification of the kind of wire on which the shrink tubing is to be placed. The characteristic may allow the printhead to print on an area related to tube width. The characteristic may also describe action other than printing which is to be carried out automatically on the elongated member. For example, the characteristic may be the desired length of segments of the elongated member, and in this event, the printing apparatus may include a cutter for cutting the elongated member into segments of the desired length.

Another feature of this invention is the use of a thermal printer, and this is particularly advantageous for printing on tubing. The thermal printer has the advantage of being readily controllable by a microprocessor, and it is capable of printing in any language using virtually any characters. The terminal printer also can print designs, bar codes and logos. Accordingly, a single printhead is suitable for a wide variety of purposes.

When a thermal printhead is used, one important characteristic of the elongated member is the type of elongated member so that it is known how hot the heatable dots of the thermal printer are to be heated in order to accomplish the printing task without danger of damaging the elongated member or the printhead. In this manner, the encoded information can automatically control the temperature of the heatable dots without danger of operator error in keying this information into a controller, such as a computer. For example, the kind of material and its color are factors that influence the degree to which the dots should be heated. The encoded information can be used to prevent the heating of heatable dots which are outside the width of the elongated member even if the heating of such dots is commanded by information which has been manually entered into the controller.

A thermal printhead is commonly justified from the left side of the printhead. Unlike what is common, this invention preferably justifies the printhead from a central region of the printhead. Accordingly the material printed on the elongated member by the printer is centered on the central region of the printhead regardless of the length of any line printed on the elongated member or the width of the elongated member. In the case of a thermal printhead, this means that the heatable dots are used first from the center outwardly rather than from the left side toward the right side. An advantage of central-region justification is that the same printhead may be used on both relatively narrow and relatively wide elongated members. Preferably although not necessarily, the printhead is justified from the center of the row of heatable dots.

When printing on paper, the variations in thickness along the length of the paper is not ordinarily very significant. However, in printing on other elongated members, such as tubing, there may be a variety of dimensional variations that must be accommodated by the printer in order to print clearly in spite of these variables. To accommodate these variables, the printhead is mounted on the supporting structure for pivotal movement about one, and preferably, at least two, generally transverse pivot axes. The printer also includes a platen, and the first pivot axis is arranged so that pivotal movement of the printhead about the first pivot axis in one direction moves the printhead away from the platen to thereby accommodate a greater thickness of the elongated member and to also allow access to the printhead.

The second pivot axis preferably extends generally in the direction in which the elongated member moves when it moves between the printhead and the platen. This accommodates overall thickness differences in the elongated member from one side to the other. Central-portion justification works particularly well and this arrangement because more even pressure is applied to the elongated member even if the printhead is tilted somewhat about the second pivot axis as a result of one side of the elongated member being thicker than the other side.

This invention also provides various reel-mounting techniques that enhance various features of this invention. For example, to assure that the encoded information on the reel can be sensed by the sensor, the sensor is preferably carried by the mounting means for the reel. In a preferred construction, the mounting means for the reel includes a wall for use in supporting the reel, and at least a portion of the wall includes a transparent window. The sensor is carried by the mounting means so that the sensor can sense the encoded information through the window. To assure that the reel will always be sufficiently close to the window and to accomplish this as simply and inexpensively as possible, the reel-mounting means includes means for causing gravity to retain the reel against the wall. Alternatively, the sensor may be located outside the periphery of the reel supporting plate, and in this event the window can be eliminated.

To facilitate central-position justification, the mounting means for the reel includes a carriage carried by the supporting structure for movement relative to the supporting structure. The carriage is movable to position the elongated member relative to the printhead to facilitate alignment of the elongated member with the printhead. In addition, the printing apparatus preferably includes means for centering b wide and narrow elongated members on the central region of the printhead.

The invention, together with additional features and advantages thereof, may best be understood by reference to the following description taken in connection with the accompanying illustrative drawings.

DESCRIPTION OF THE PREFERRED EMBODIMENT

Figure 1:
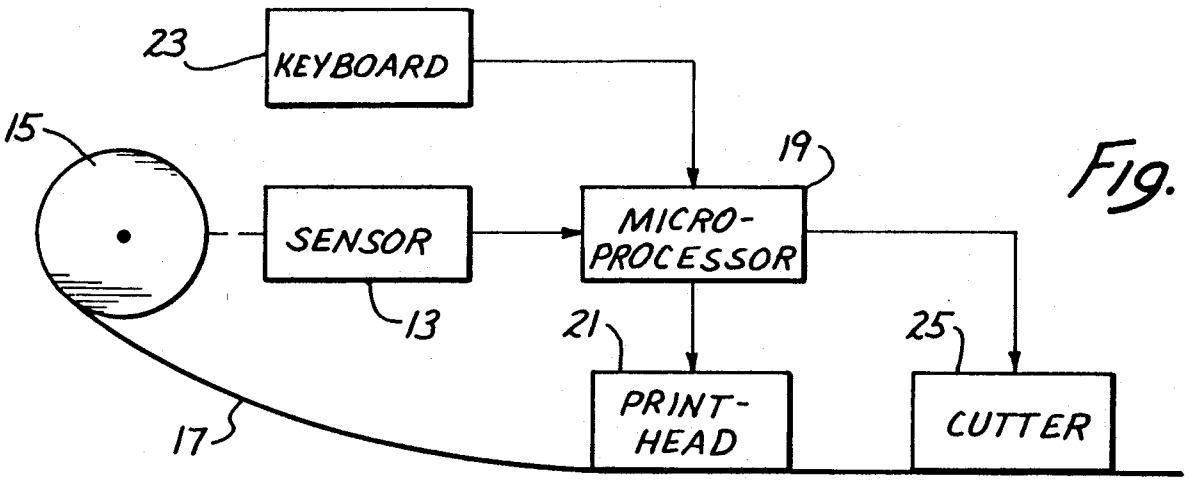
FIG. 1 is a schematic block diagram of one form of printing apparatus constructed in accordance with the teachings of this invention.

FIG. 1 shown a simplified block diagram of a printing apparatus 11 which generally comprises a sensor 13 for reading encoded information on a feel 15 of tubing 17 and providing a signal to a controller, such as a microprocessor 19, related to the encoded information on the reel. The apparatus 11 also includes a printhead 21 for printing information on the tubing 17 in accordance with the encoded information as commanded by the microprocessor. A keyboard 23 can be used to key information into the microprocessor that should also be printed on the tubing 17, and this is typically in addition to the information printed as required by the encoded information on the reel. The microprocessor 19 is programmed so that commands from the sensor 13 override any conflicting commands from the keyboard 23. In this manner, the encoded information on the reel 15 overrides keyboard commands so as to factor out operator error in the case of conflicting information.

The printing apparatus 11 may optionally include a cutter 25 to cut the tubing 17 into segments. The resulting tubing segments may be completely severed from each other or only partially severed so that the tubing segments are joined by a tiny web material that will allow them to be wound as a unit onto a takeup reel (not shown in FIG. 1).

Figure 2:
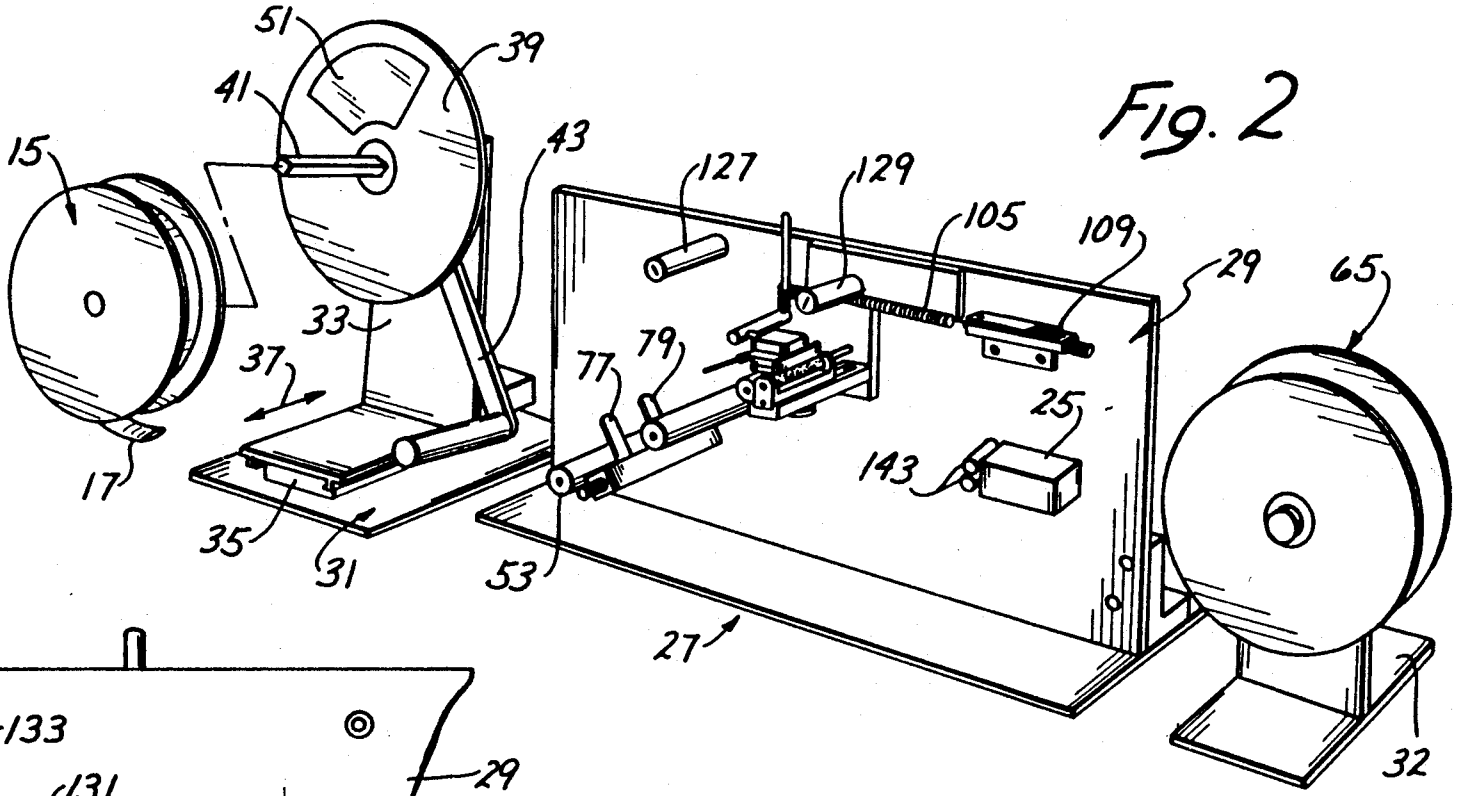
FIG. 2 is a perspective view of the printing apparatus and a reel of tubing.

FIG. 2 illustrates a preferred form that the printing apparatus 11 may assume. As shown in FIG. 2, the apparatus 11 includes a supporting structure 27 which comprises three separate supporting sections 29, 31 and 32. Although the supporting sections 29, 31 and 32 are separate in FIG. 2, they can be joined, if desired. A generally L-shaped carriage 33 is mounted on the supporting section 31 by a track 35 and suitable bearings (not shown) to allow the carriage 33 to move back and forth in the direction of the double arrow in FIG. 2 to roughly center the tubing on the printhead 21.

A wall in the form of a plate 39 is fixedly mounted on a rotatable, angled, square shaft 41 (FIGS. 2 and 9) which is suitably journaled at an angle into the carriage 33. The shaft 41 extends perpendicular to the plate 39, but both of these are inclined so that the shaft 41 is inclined upwardly as it extends away from the plate 39, and the plate 39 is inclined relative to the vertical.

The reel 15 has a central round opening 40 which receives the square shaft 41 sufficiently tightly so that the reel and shaft rotate together. The angle of the shaft 41 and of the plate 39, whether considered singly or in combination, form means for causing gravity to retain the reel 15 against the plate 39.

A brake 42 (FIG. 9), which may be of conventional construction, normally holds the shaft 41, and hence the plate 39, against rotation. The brake 42 can be released by pivoting a dancer arm 43 upwardly in the direction of the arrow in FIG. 9 to rotate a dancer arm shaft 45 clockwise as viewed in FIG. 9. The shaft 45 is rotatably mounted on the carriage 33, and the dancer arm 43 is affixed to the shaft 45. Rotation of the shaft 45 creates slack in a rubber belt 47, which is coupled at one end to the shaft 45 and at its other end to a fixed pin 49 on the carriage 33. The friction between the belt 47 and the shaft 41 normally retains the shaft 41 against rotation. However, a slight elevation of the dancer arm 43 creates sufficient slack in the belt 47 so as to release the shaft 41 for rotation. If desired, a spring (not shown) can be used to bias the dancer arm 43 downwardly. Pulling of the tubing 17 as described below from the reel 15 causes the tubing 17 to raise the dancer arm 43 sufficiently to allow the shaft 41, the plate 39 and the reel 15 to rotate together.

Figures 4, 9:
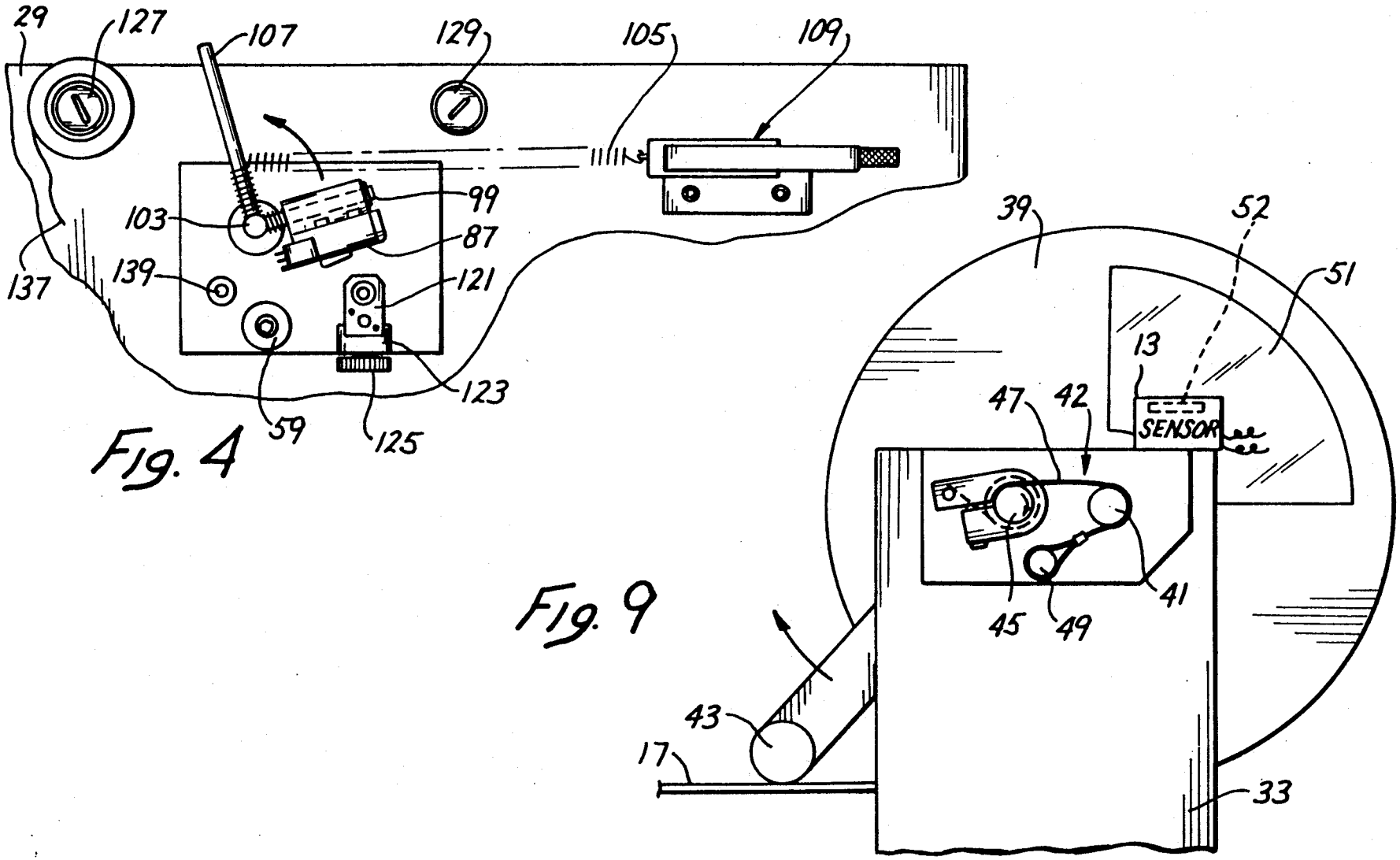
FIG. 4 is an enlarged, fragmentary view of a portion of the printing apparatus, with the printhead pivoted counterclockwise about one of its pivot axes.
FIG. 9 is a rear elevational view of the mounting means for the reel.

A transparent window 51 is provided in the plate 39. The sensor 13 is mounted on the supporting section 31 by the carriage 33 and, more specifically, is mounted on the upper end of the carriage 33 as shown in FIG. 9 so that it can sense or read through the window 51 encoded information, such as a bar code 52 (FIG. 9), on the reel 15. Although the sensor 13 may be of various different kinds, in this embodiment, it is an optical scanner which provides an electronic signal to the microprocessor 19 (FIG. 1) to, in effect, transmit the sensed encoded information to the microprocessor. By mounting the sensor 13 as shown in FIG. 9, and by having the plate 39 and the shaft 41 inclined as described above, the reel is kept close to the sensor so that the encoded information can be easily read.

The tubing 17 passes beneath the dancer arm 43 (FIG. 9), beneath an idler roller 53 (FIG. 9), through a tube-centering device 55, over an idler roller 57 and a centering roller 59, through a printer 61 and the optional cutter 25 to a take-up reel 65 (FIG. 2) which is rotatably mounted on the supporting section 32. Basic or gross alignment of the tubing 17 with the printer 61 is provided by moving the carriage 33 relative to the supporting section 31 in the direction of the double-headed arrow 37 (FIG. 2). The carriage 33 is retained in whatever position it is placed in by friction.

Figure 6:
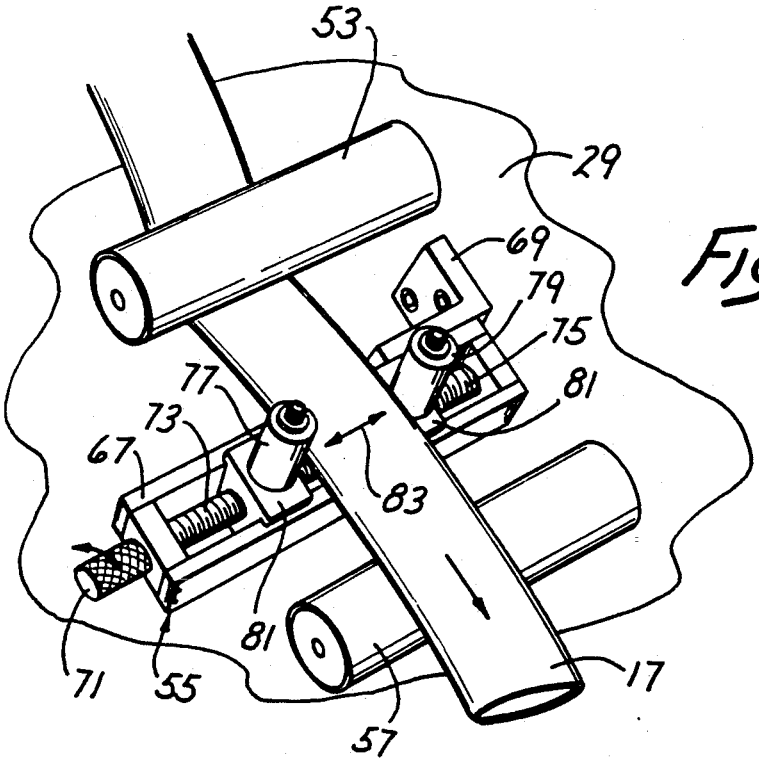
FIG. 6 is an enlarged, perspective view illustrating one form of centering means for the elongated member and adjacent structure.

More accurate centering of relatively wide tubing 17 can advantageously be obtained by the centering device 55, which in this embodiment, includes a box frame 67 (FIG. 6) attached by a bracket 69 to the supporting section 29. The centering device 55 also includes a screw 71 mounted for rotation on the frame 67 and having oppositely threaded portions 73 and 75 on which guide members 77 and 79 are mounted by nuts 81, respectively. The guide members 77 and 79 project upwardly to guide the tubing 17 that passes between them. The guide members 77 and 79 can be moved together toward and away from each other by rotation of the screw 71. In this manner, the tubing 17 can be centered as desired on the printer 61.

The rollers 53, 57 and 59 are suitably rotatably mounted on the supporting section 29. The centering roller 59 has a central annular groove 85 (FIG. 5) sized to receive small-diameter tubing. The groove 85 is aligned with a central portion of the printhead 21, and thus can be used to center small-diameter tubing relative to the printer.

The printer 61 includes the printhead 21 and a platen 89 in the form of a platen roller. The printer may also be considered to include a heat sink 91 and a mounting block 93, all suitably interconnected.

Figure 5:
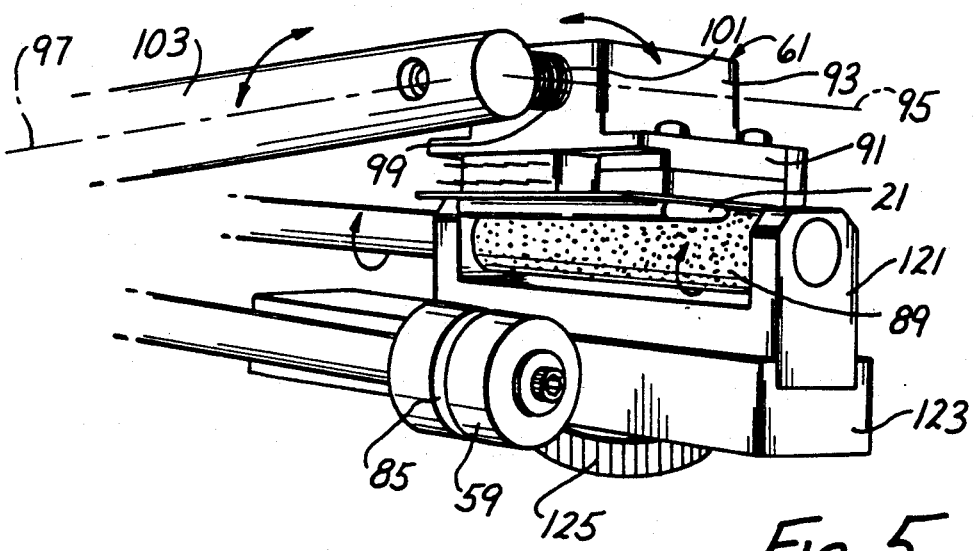
FIG. 5 is an enlarged, perspective view illustrating a portion of the printing apparatus adjacent the printhead.

The printhead 21 is mounted for pivotal movement about transversely extending pivot axes 95 and 97, FIG. 5. More specifically, the printhead 21 is mounted for pivotal movement about the axis 95 by a shaft 99 (FIGS. 3-5) which extends through the mounting block 93 in a way that will allow pivotal movement of the mounting block and the printhead 21 about the axis 95. As can be seen from FIGS. 3-5 and 10, the axis 95 extends in the same general direction as the direction in which the tubing 17 moves through the printer 61. An optional spring 101 urges the mounting block 93 to the right as viewed in FIG. 5.

To mount the printhead 21 for pivotal movement about the axis 97, the shaft 99 is affixed to a transverse shaft 103 which in turn is journaled into the supporting section 29 for pivotal movement about the axis 97. The shaft and the printhead 21 are biased clockwise as viewed in FIG. 4 by a spring 105 which is attached at one end to a lever 107 affixed to the shaft 103 and at the other end to a tension adjuster 109 which is affixed to the supporting section 29.

Figure 7:
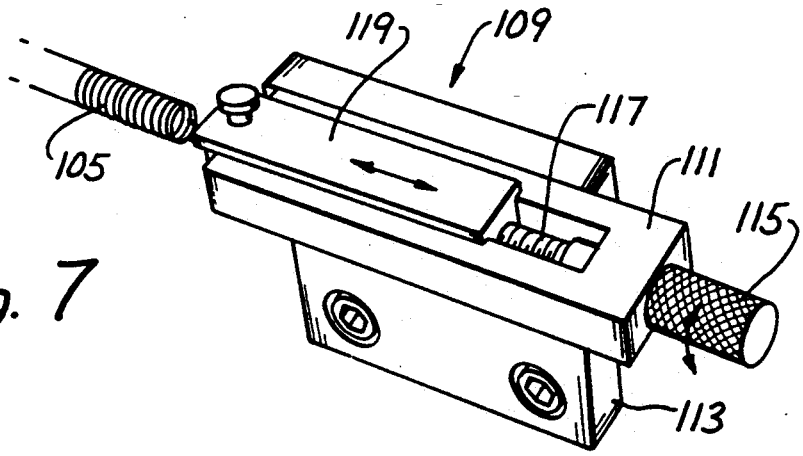
FIG. 7 is a perspective view illustrating one way for adjusting the tension on a spring to adjust the pressure of the printhead against tubing or other elongated member.

The tension adjuster 109 can be of any construction which will permit the tension on the spring 105 to be adjusted. In the form shown in FIG. 7, the tension adjuster includes a U-shaped frame 111 mounted on the supporting section 29 by a mounting plate 113. A rotatable member 115 having a threaded portion 117 is mounted for rotation on the U-shaped frame 111 with the threaded portion 117 extending between the legs of the U. An elongated nut 119 is mounted on the threaded portion 117 and held against rotation by the frame 111 so that rotation of the rotatable member 115 causes the nut 119 to translate in the direction of the double headed arrow in FIG. 7. One end of the spring 105 is affixed to the nut 119 so that rotation of the rotatable member 115 can increase or decease the tension on the spring 105. By increasing the tension on the spring 105, the force with which the printhead 21 is pivoted clockwise as viewed in FIG. 5 against that platen 89 is increased.

The platen 89 which may be of conventional construction, is rotatably mounted on a yoke 121 (FIG. 5) which is slidably received in a mounting block 123. The mounting block 123 is suitably attached to the supporting section 29. The platen 89 is releasably retained on the mounting block 123 by a screw 125. By loosening of the screw 125, the yoke 121 and the platen 89 can be removed from the mounting block 123 for inspection, repair or replacement.

Figure 3:
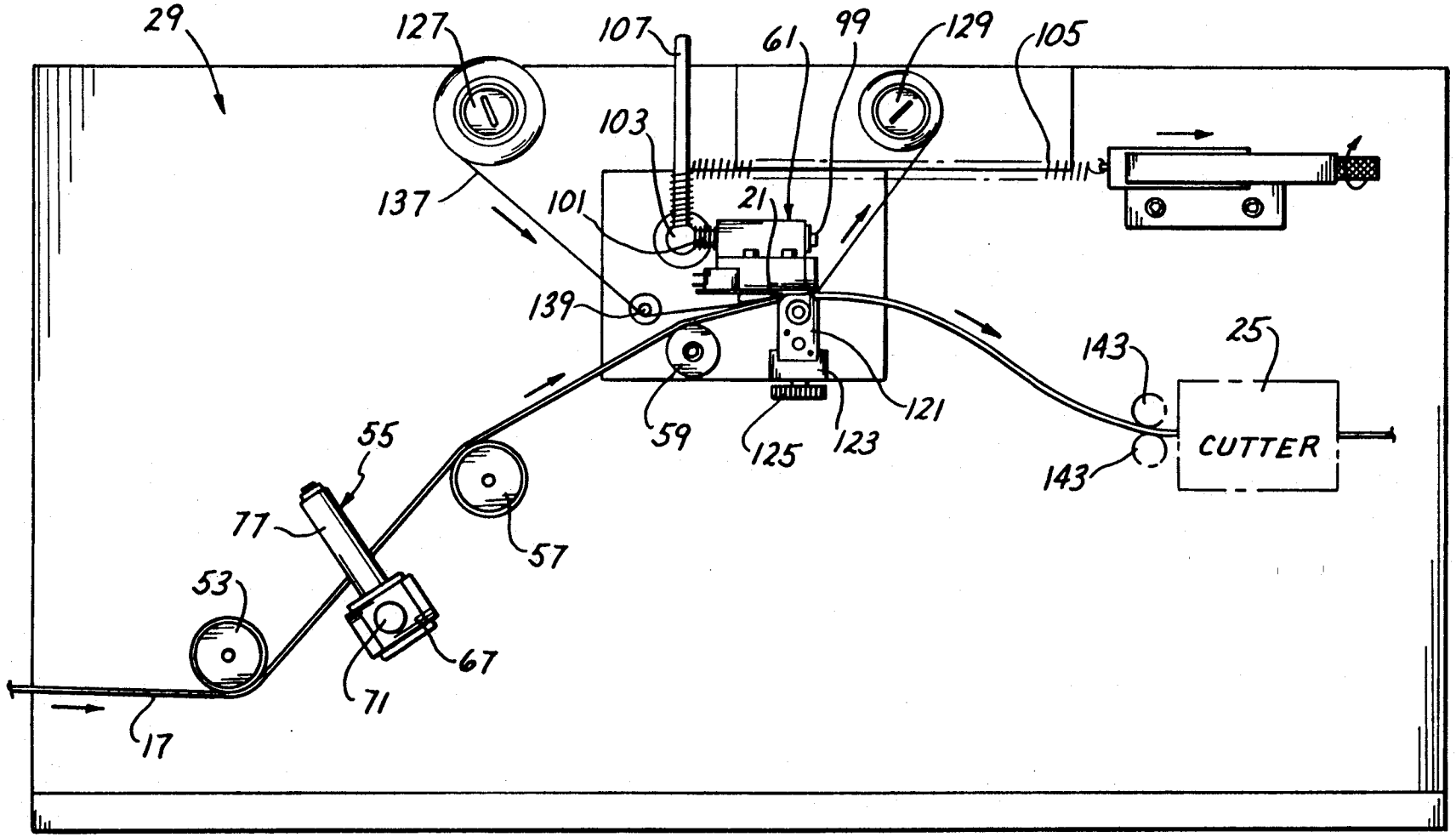
FIG. 3 is a front elevational view of a portion of the printing apparatus.

The printer 61 includes a ribbon drive system (FIGS. 2–4) which includes a supply shaft 127 and a takeup shaft 129, both of which are rotatably mounted on the supporting section 29. Rotation of the supply shaft 127 is retarded by a brake (not shown) and the takeup shaft 129 is driven by a motor 131 (FIG. 8), a belt 133, pulley 135 and a slip clutch (not shown). A roll of ribbon 137, which is commonly provided on a core, can be mounted on the supply shaft 127 for rotation with the supply shaft as shown in FIGS. 3 and 4, and the ribbon can be extended beneath a ribbon guide 139 (FIGS. 3 and 4) between the printhead 21 and the platen 89 to a takeup shaft 129. With this arrangement, the ribbon 137 is pulled over the printhead 21, and the slip clutch (not shown) for the takeup shaft 129 accommodates the varying diameters of ribbon on the shafts 127 and 129.

Although the tubing 17 can be advanced through the printer 61 in different ways, in this embodiment, this is accomplished by driving the platen 89. To accomplish this, the motor 131 (FIG. 8) directly drives the platen 89 so that the platen 89 rotates and the friction between it and the tubing 17 pulls the tubing from the reel 15 and advances the tubing through the printer 61.

Figure 8:
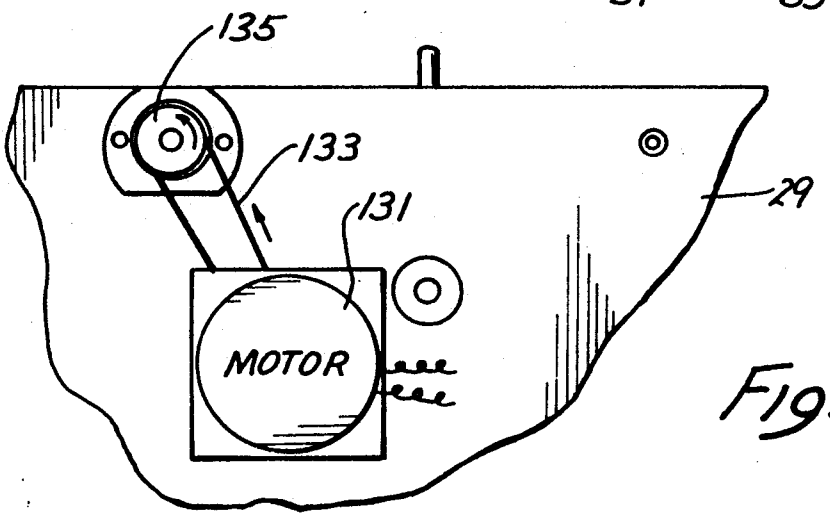
FIG. 8 is a fragmentary, rear elevational view of the drive means for the elongated member and the platen roller.

After leaving the printer 61, the tubing 17 may be subjected to further processing if desired. For example, it may pass through the cutter 25 which may completely sever the tubing 17 into separate tubing segments. Alternatively, the cutter 25 may only partially sever the tubing 17 so that the segmented tubing can be wound on the take up reel 25. Of course, the cutter 25 can be eliminated and the tubing 17 wound on the takeup reel 65. The takeup reel 65 may be driven by a separate motor or by a suitable power takeoff from the motor 131 (FIG. 8). Similarly, the cutter 25 may include drive rolls 143, which may be driven by the motor 131 (FIG. 8) or a separate motor to pull the tubing through the cutter. Alternatively the platen 89 may push the tubing 17 through the cutter 25.

Figure 10:
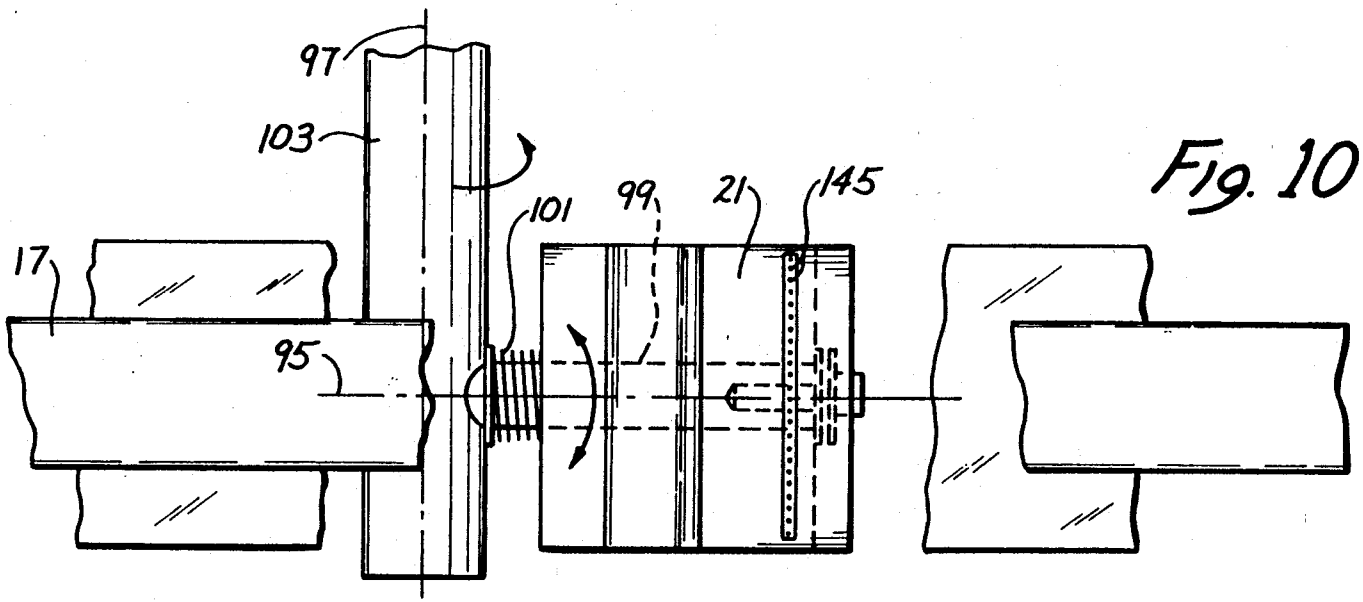
FIG. 10 a bottom plan view of the printhead and adjacent structure.

The printhead 21 may be a conventional thermal printhead of the type manufactured by Kyocera. As such, the printhead 21 includes a row of heatable dots 145 (FIG. 10). By selectively heating the dots 145 in a known manner, virtually any character, design or logo can be printed on the tubing 17. Specifically, a heated dot is effective to transfer ink from the ribbon 137 to the tubing 17 whereas an unheated dot 145 will not transfer any ink to the tubing. A heated dot 145 cools sufficiently after the formation of one dot on the tubing 17 so as to be ineffective for the second line of printing if that dot is then unheated.

Because the printhead 21 is center justified, each line printed by the line of dots 145 is centered on the axis 95 (FIG. 10) which bisects the line of dots. For example, if the information to be printed consisted solely of the letter "a" that letter would be centered on the axis 95 rather than appearing at the extreme left end of the line of dots 145. This change can be carried out by appropriately programming the microprocessor 19.

In operation, the reel 15 is installed on the shaft 41 and pushed back against the window 51 so that the bar code 52 can be seen by the sensor through the window. Gravity and friction tend to hold the reel against the plate 39. The tubing 17 is strung through the printing apparatus 11 as shown in FIG. 3, and the free end of the tubing 17 may extend into the cutter 25 and/or be affixed to the takeup reel 65. The motor 131 is started and the bar code 52 is read by the sensor 13 and a signal related to the information contained in the bar code is applied to the microprocessor 19 which in turn controls the printhead and the cutter 25. As the tubing 17 moves through the printing apparatus 11, the printhead 21 pivots about the axes 95 and 97 as may be required to accommodate varying thicknesses of the tubing and allows even printhead pressure on the tubing. The printhead 21 prints information on the tubing as commanded by the microprocessor 19 in the center justified manner as described above. The tubing 17 is centered on the printhead 21 by the centering device 55 or the centering roller 59 depending on the diameter of the tubing.

Assuming that the bar code 52 contains information as to the width of the tubing 17, the signal applied by the sensor 13 to the microprocessor 17 commands that the dots 145 of the printhead 21 not be heated outside the width of the tubing. With reference to FIG. 10, this means that the dots at the opposite ends of the row of dots 145 would not be heated even if, due to operator error, information were keyed in at the keyboard 23 which would otherwise command a relatively long line of information be printed on the tubing. This override feature prevents possible damage to the printhead 21 as a result of heating of dots 145 which cannot be used for printing.

Although an exemplary embodiment of the invention has been shown and described, many changes, modifications and substitutions may be made by one having ordinary skill in the art without necessarily departing from the spirit and scope of this invention.

I claim:

1. A printing apparatus for printing on an elongated member wherein encoded information relating to at least one characteristic of the elongated member is associated with the elongated member, said printing apparatus comprising:

a supporting structure;

a controllable printer mounted on the supporting structure for printing on the elongated member, said printer including a printhead;

sensor means for sensing the encoded information;

means for controlling the printer in accordance with the encoded information whereby the printer is controlled in accordance with said characteristic of the elongated member, said controlling means including means for justifying the printhead from a central region of the printhead; and means for centering the elongated member on the central region of the printhead.

2. An apparatus as defined in claim 1 wherein the elongated member is wound on a reel and the printing apparatus includes means for mounting the reel for rotation on the supporting structure whereby the elongated member can be unwound from the reel and moved past the printing apparatus.

3. An apparatus as defined in claim 2 wherein the encoded information is on one of the reel and the elongated member and sensor means is carried by the mounting means for the reel.

4. An apparatus as defined in claim 1 wherein the printer includes a thermal printhead.

5. A printing apparatus for printing on an elongated member comprising:

a supporting structure;

a printer including a thermal printhead having a plurality of heatable dots and a platen;

means for mounting the platen on the supporting structure;

means for mounting the printhead on the supporting structure for pivotal movement relative to the supporting structure and platen to allow an elongated member of varying dimensions to pass between the printhead and the platen;

means for advancing the elongated member through the printer between the printhead and the platen; and means for justifying the printhead from a central region of the printhead whereby the printing on the elongated member by the printer is centered on the central region of the printhead regardless of a length of any line printed on the elongated member.

6. An apparatus as defined in claim 5 including means for centering the elongated member on the central region of the printhead.

7. An apparatus as defined in claim 5 wherein the mounting means for the printhead includes means for mounting the printhead on the supporting structure for pivotal movement about at least first and second generally transverse pivot axes with pivotal movement of the printhead about said first pivot axis in one direction moving the printhead away from the platen to facilitate operator access to printhead.

8. An apparatus as defined in claim 7 wherein second pivot axis extends generally in a direction to provide more even pressure of the printhead on the elongated member.

9. An apparatus as defined in claim 5 wherein the elongated member is wound on a reel and the apparatus includes a carriage carried by the supporting structure for movement relative to the supporting structure, means for mounting the reel for rotation on the carriage so that the elongated member can be unwound from the reel and moved through the printing apparatus, said carriage being movable to position the elongated member relative to the printhead.

10. A method of printing on tubing wherein encoded information relating to at least one characteristic of the tubing is associated with the tubing, said method comprising:

sensing the encoded information using a sensor;

advancing the tubing through a printer; and controlling the printer in accordance with the encoded information whereby the printer is controlled in accordance with said characteristic of the tubing.

11. A method as defined in claim 10 wherein said one characteristic is whether the tubing is authorized for use with the printer and said step of controlling includes operating the printer to print on the elongated member only if the tubing is authorized.

12. A method as defined in claim 10 wherein the printer includes a thermal printhead having a plurality of heatable dots, said one characteristic is a factor about the tubing that influences how hot the heatable dots should be heated and said step of controlling includes heating selected dots to a temperature compatible with said factor about the tubing to print desired information on the tubing.

13. A method as defined in claim 10 wherein the tubing has a width dimension and the printer includes a thermal printhead having a plurality of heatable dots, said one characteristic is the width dimension of the tubing, said step of controlling is carried out with a controller, manually entering information into the controller for printing on the tubing and said step of controlling includes preventing the heating of heatable dots which are outside the width of the tubing even if the heating of such dots is commanded by the manually entered information.

14. A method as defined in claim 10 wherein the tubing is shrink tubing.

15. A printing apparatus for printing on an elongated member wherein encoded information relating to at least one characteristic of the elongated member is associated with the elongated member, said printing apparatus comprising:

a supporting structure;

a controllable printer mounted on the supporting structure for printing on the elongated member;

sensor means for sensing the encoded information;

means for controlling the printer in accordance with the encoded information whereby the printer is controlled in accordance with said characteristic of the elongated member;

the elongated member being wound on a reel and the printing apparatus including means for mounting the reel for rotation on the supporting structure whereby the elongated member can be unwound from the reel and moved through the printing apparatus; and the mounting means for the reel including a wall for use in supporting the reel, at least a portion of said wall including a transparent window and said sensor means including an optical sensor carried by the mounting means so the optical sensor can sense the encoded information through the window.

16. An apparatus as defined in claim 15 wherein the mounting means includes means for causing gravity to retain the reel against the wall.

17. An apparatus as defined in claim 15 wherein the printer includes a thermal printhead.

18. A printing apparatus for printing on an elongated member wherein encoded information relating to at least one characteristic of the elongated member is associated with the elongated member, said printing apparatus comprising:

a supporting structure;

a controllable printer for printing on the elongated member, said printer including a printhead and a platen;

means for mounting the printhead on the supporting structure for pivotal movement about at least first and second generally transverse pivot axis with the pivotal movement of the printhead about said first pivot axis in one direction moving the printhead away from the platen to accommodate a greater thickness of the elongated member and to facilitate access to the printhead;

sensor means for sensing the encoded information; and means for controlling the printer in accordance with the encoded information whereby the printer is controlled in accordance with said characteristic of the elongated member.

19. A printing apparatus for printing on tubing wherein encoded information relating to at least one characteristic of the tubing is associated with the tubing, said printing apparatus comprising:

a supporting structure;

a controllable printer mounted on the supporting structure;

means for advancing the tubing past the printer;

means for printing on the tubing as the tubing moves past the printer;

sensor means for sensing the encoded information; and means for controlling the printer in accordance with the encoded information whereby the printer is controlled in accordance with said characteristic of the tubing.

20. An apparatus as defined in claim 19 wherein the printer includes a ribbon for use in printing on the tubing.

21. A printing apparatus for printing on an elongated member comprising:

a supporting structure;

a printer including a thermal printhead having a plurality of heatable dots and a platen;

means for mounting the platen on the supporting structure;

means for mounting the printhead on the supporting structure for pivotal movement about an axis and relative to the supporting structure and platen;

means for advancing the elongated member in a first direction through the printer between the printhead and the platen;

said first direction and said axis extending generally in the same direction; and means for justifying the printhead from a central region of the printhead whereby the printing on the elongated member by the printer is centered on the central region of the printhead regardless of the length of any line printed on the elongated member.

22. A method of printing on an elongated tubular member wherein encoded information relating to at least one characteristic of the elongated tubular member is associated with the elongated tubular member, said method comprising:

sensing the encoded information using a sensor;

advancing the elongated tubular member through a printer; and controlling the printer in accordance with the encoded information whereby the printer is controlled in accordance with said characteristic of the elongated tubular member.

* * * * *

UNITED STATES PATENT AND TRADEMARK OFFICE

CERTIFICATE OF CORRECTION

PATENT NO. : 5,184,152

DATED : February 2, 1993

INVENTOR(S) : John B. French

It is certified that error appears in the above-identified patent and that said Letters Patent is hereby corrected as shown below:

On the title page, [73] "Assignee", change "Sumimoto" to -- Sumitomo -- .

Column 1, line 44, change "ticket" to -- ticketing -- .

Column 1, line 45, change "bar printers" to -- bar code printers -- .

Column 2, line 52, change "terminal to -- thermal -- .

Column 3, line 40, after "well", change "and" to -- with -- .

Column 4, line 3, after "centering" change "b" to -- both -- .

Column 4, line 35, after "10" insert -- is -- .

Column 4, line 42, after "a", change "feel" to -- reel -- .

Column 5, line 6, after "arrow" insert -- 37 -- .

Column 5, line 57, after "idler roller 53" change "(Fig. 9)" to -- (Fig. 3) -- .

Column 6, line 40, after "shaft" insert -- 103 -- .

UNITED STATES PATENT AND TRADEMARK OFFICE

CERTIFICATE OF CORRECTION

PATENT NO. : 5,184,152

DATED : February 2, 1993

INVENTOR(S) : John B. French

It is certified that error appears in the above-indentified patent and that said Letters Patent is hereby corrected as shown below:

Column 9, line 54, change "elongated member" to --tubing--.

Column 10, line 50, after "pivot" change "axis" to --axes--.

Signed and Sealed this

Eighteenth Day of January, 1994

*Attest:*

*Attesting Officer*

Bruce Lehman

BRUCE LEHMAN

*Commissioner of Patents and Trademarks*